United States Patent [19]

Mathis

[11] Patent Number: 4,542,854

[45] Date of Patent: Sep. 24, 1985

[54] WHIRLPOOL JETS

[76] Inventor: Cleo D. Mathis, 1808 Potrero Ave., South El Monte, Calif. 91733

[21] Appl. No.: 619,484

[22] Filed: Jun. 11, 1984

Related U.S. Application Data

[63] Continuation of Ser. No. 315,491, Oct. 27, 1983, abandoned.

[51] Int. Cl.[4] ..... B05B 15/08; A47K 3/10

[52] U.S. Cl. ..... 239/587; 239/416.4; 239/428.5; 4/492; 4/542; 128/66

[58] Field of Search ..... 239/413, 416, 416.4, 239/416.5, 428.5, 429, 587; 4/492, 542, 543, 544; 251/142, 149, 149.2; 128/66

[56] References Cited

U.S. PATENT DOCUMENTS

| | | | |
|---|---|---|---|
| 2,406,997 | 9/1946 | Curry | 239/416.5 |
| 2,799,866 | 7/1957 | Jawett | 4/542 X |
| 3,067,435 | 12/1962 | Nash | 4/492 X |
| 3,297,025 | 1/1967 | Jacuzzi | 128/66 |
| 3,304,936 | 2/1967 | Kosta | 128/66 |
| 3,471,091 | 10/1969 | Baker | 239/416 |
| 3,874,374 | 4/1975 | Jacuzzi | 128/66 |
| 3,890,655 | 6/1975 | Mathis | 128/66 X |
| 3,890,656 | 6/1975 | Mathis | 128/66 X |
| 3,946,449 | 3/1976 | Mathis | 128/66 X |
| 3,964,472 | 6/1976 | Nicollet | 128/66 |
| 4,262,371 | 4/1981 | Berry et al. | 128/66 X |
| 4,264,039 | 4/1981 | Moreland | 239/428.5 |
| 4,335,854 | 6/1982 | Reynoso | 239/428.5 |
| 4,349,923 | 9/1982 | Chalberg | 4/542 |
| 4,408,721 | 10/1983 | Cohen et al. | 239/428.5 X |
| 4,416,030 | 11/1983 | Reynoso | 4/496 |

*Primary Examiner*—Andres Kashnikow
*Assistant Examiner*—James R. Moon, Jr.
*Attorney, Agent, or Firm*—Edward J. DaRin

[57] ABSTRACT

A whirlpool jet housing having a unitary combination orifice and directional flow that can be readily coupled and decoupled from the jet housing. The combination orifice and directional flow includes means for drawing air into the directional flow immediately prior to discharge of the water and thereby discharge a mixture of air and water. The combination orifice and directional flow is adapted to permit the coupling to the water aperture for the jet housing to be continuously varied between a fully on and fully off position to vary the volume of water discharged. Control means are further provided to permit the user to turn the air fully on or fully off at the jet housing while controlling the flow of water at the housing. The whirlpool jet housing includes improved means for mounting the housing to a water vessel and an improved installation tool for use therewith.

27 Claims, 18 Drawing Figures

FIG. 12.
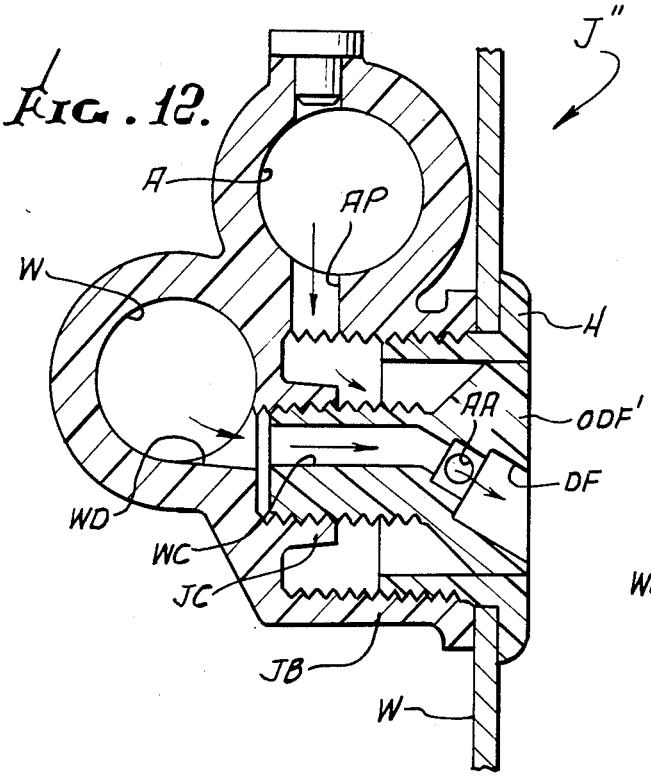
FIG. 13.
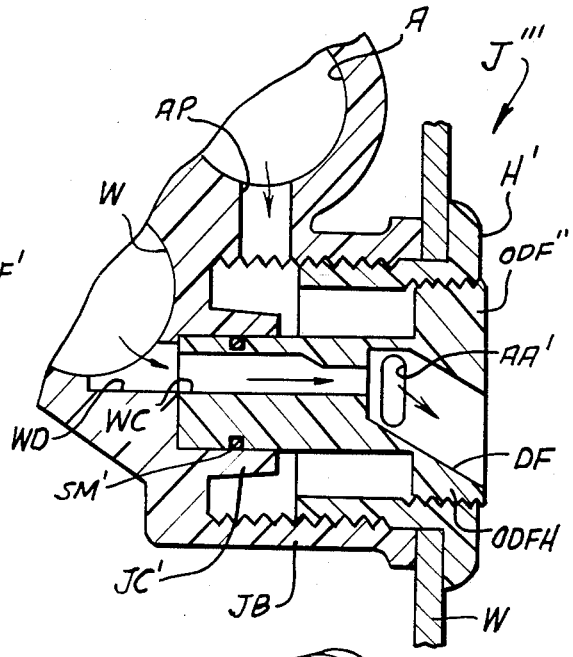
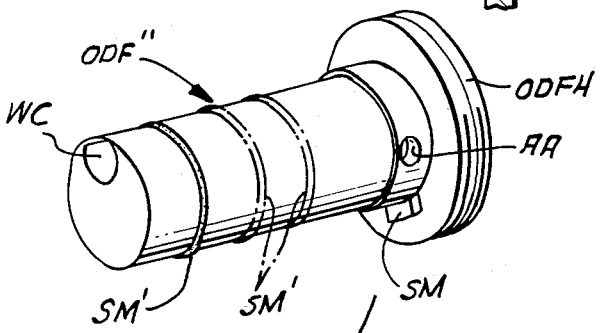
FIG. 15.
FIG. 14.
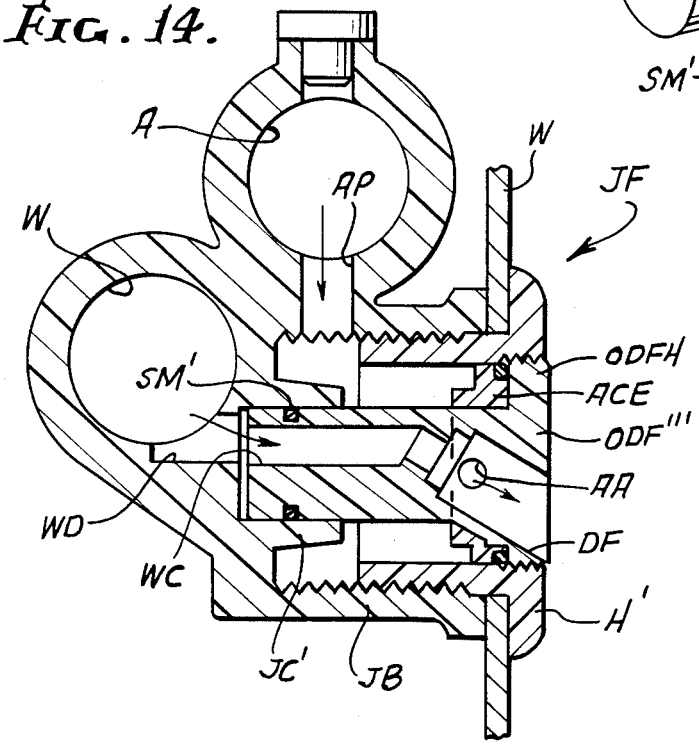
FIG. 16.
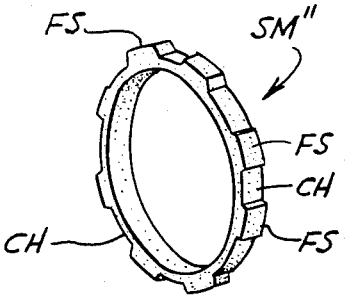

WHIRLPOOL JETS

CROSS REFERENCE TO RELATED APPLICATIONS

This is a continuation of application Ser. No. 315,491 filed Oct. 27, 1981, now abandoned.

This invention relates to whirlpool jets for use in hydrotherapy systems, or the like, and which jets are mounted to water vessels such as bathtubs, hot tubs, spas, or the like.

BACKGROUND OF THE INVENTION

This invention is directed to an improved whirlpool jet for use in hydrotherapy systems of the type disclosed in my U.S. Pat. Nos. 3,890,655, 3,890,656, and 3,946,449, and improved spanner wrenches for use with the improved whirlpool jets. My U.S. Pat. No. 3,890,656 discloses to the art a whirlpool jet having a body portion including side by side, mutually parallel, individual water and air conduits integrally molded with the body portion in plastic to permit slip couplings of suitable air and water lines thereto. The water line couples water under pressure to the whirlpool jet body. The water under pressure causes air to be drawn in to the jet body by well known venturi action and the air and water are mixed in a mixing chamber and discharged at a preselected direction into the water stored in the water vessel. These types of whirlpool jets have been widely used in hydrotherapy systems. To my knowledge, there is not available a whirlpool jet that permits the flow of water to be turned off, or the volume of water to be controlled, or the air to be turned off at the jet proper. Accordingly, there is presently a need for an improved whirlpool jet that includes these control functions integral with the whirlpool jet.

SUMMARY OF THE INVENTION

The present invention provides an improved whirlpool jet wherein the air and water are mixed immediately prior to being discharged as a mixture of air and water into a water vessel. In this improved arrangement the flow action of the water is not lost and the water is not compressed. In a specific embodiment of the invention the air is coupled into the discharge outlet of the whirlpool jet and, in particular, into the directional flow outlet. The improvements of the whirlpool jets disclosed herein result in a less expensive whirlpool jet to manufacture and one that can be retrofitted to the presently available jets and, in particular, the whirlpool jet disclosed in my U.S. Pat. No. 3,890,656. In the improved structural organization for mixing water and air in accordance with the present invention, the jet is advantageously constructed and defined so that the volume of water that flows through the whirlpool jet can be controlled at the jet and either cause the water to be turned fully on, fully off, or some intermediate volume of water flow, in accordance with the selected adjustment of the improved control means for the whirlpool jet. The whirlpool jet can be defined with a positive directional flow and with a finger tip control at the jet to cause the flow of water to be varied as desired between the fully off and fully on position. In addition, the whirlpool jet may include control means on the jet for controlling the flow of air into the jet from a fully on or fully off position while controlling the flow of water. The whirlpool jet includes improved means for mounting the whirlpool jet to the wall of a water vessel without the use of any tightening holes defined on the front face of the jet head resulting in what some consider an unsightly appearance for the completely installed whirlpool jet. Accordingly, an improved whirlpool jet installation tool, or spanner wrench, is disclosed for use with the improved construction of the whirlpool jet that eliminates the holes in the face of the head. The whirlpool jet is further constructed and defined with a unique orifice and directional control element that not only provides positive directional control, but allows the combination orifice and directional flow to be readily removed without any special tools to permit the whirlpool jet to be readily cleaned out. To this end the combination orifice and directional flow merely needs to be decoupled or screwed out from the venturi body, the whirlpool body cleaned out and then coupled or screwed back into position for reuse.

From a structural standpoint and in its broadest aspect, the whirlpool jet of the present invention comprises a whirlpool jet housing having a body portion, a water inlet means including an aperture for conveying water into the body portion, and air inlet means including an aperture for conveying air into the body portion, along with a combination orifice and directional flow having an orifice at one end thereof arranged adjacent the water aperture to receive water therefrom, and a directional flow at the opposite end thereof with a water conduit extending between the two ends. The combination orifice and directional flow includes aperture means for conveying air therein for mixture with the water conveyed through the water conduit of the orifice and directional flow and to cause the air and water to be mixed and discharged from the directional flow in a preselected direction. The whirlpool jet housing includes a head adapted to be secured to the body portion so as to secure the whirlpool jet to a wall of the water vessel, or the like, through an aperture in the wall when the head and body are arranged on opposite sides of the wall without any additional securing devices, the head including an internally defined segment means for receiving and coacting with a complementary shaped wrench for tightly securing the body portion and head to the wall by means of an aperture through the wall. A further improvement of the basic structure of the whirlpool jet is directed to the combination orifice and directional flow, which is constructed and defined as a unitary structure to be rotatable to place the orifice end of the water conduit in direct communication with the water inlet means and rotatable to a preselected position to place the orifice end of the water conduit out of communication with the water inlet means and thereby close off the water inlet means relative to the orifice. This advantageous unitary structure for the combination orifice and directional flow may include air control means rotatably mounted outside of the directional flow and adjacent to the air aperture for admitting air into the directional flow whereby the aperture means for admitting air therein is controlled in response to the rotation of the combination orifice and directional flow to convey water therethrough and to permit the positioning of the aperture means to draw air therein and to block off the aperture means in response to the relative rotation between the orifice and directional flow and the air control means.

In a specific embodiment of the improved whirlpool jet the whirlpool jet housing comprises a body portion having an aperture for conveying water into the body portion and an aperture for conveying air into the body portion, the body portion including side by side, mutually parallel, individual water and air conduits integrally molded with the body portion. One of the conduits is constructed and defined relative to one of the water and air apertures to be in communication therewith, with the other one of said conduits being constructed and defined relative to the remaining one of the water and air apertures to be in communication therewith. Control means is coupled to the body portion with one end arranged adjacent said water aperture and having an internally defined longitudinally extending water conveying channel to receive water conveyed through said water aperture and to discharge the water at the opposite end thereof. The control means includes an air conveying aperture adjacent the water discharge end to cause the water in the water conveying channel to be mixed prior to discharge from the control means. The whirlpool jet includes a head adapted to be coupled to the body portion and mounting the control means to permit the mixed water and air to be discharged therethrough while closing off the body portion. The control means is rotatable relative to the body portion and the head to permit the coupling between the water aperture for the body portion and the water conveying channel to be continuously varied from a fully coupled position to cause the water to fully flow through the water channel and to a decoupled position to shut off the water from said water channel in response to the rotation thereof.

The aforementioned specific embodiment of the whirlpool jet housing may further include air control means mounted with the first mentioned control means adjacent the air conveying aperture to cause air to be conveyed into the water conveying channel when the channel is fully coupled to the water aperture and constructed and defined to permit relative rotation between the first mentioned control means and the air control means to cause the air conveying aperture of the first mentioned control means to be closed off in response to the rotation of the first mentioned control means.

These and other features of the present invention may be more fully appreciated when considered in the light of the following specification and drawings in which:

BRIEF DESCRIPTION OF THE DRAWINGS

FIG. 12 is a cross sectional view of an embodiment of the whirlpool jet wherein the water only is continuously controlled between the fully on and fully off position;

FIG. 13 is an alternate embodiment of the whirlpool jet of FIG. 12 for continuously controlling the water flow;

FIG. 14 is a further embodiment of the whirlpool jet of FIG. 13 illustrating controls for both the air and water;

FIG. 15 is a detached view of the combination orifice and directional flow for controlling the water and air, as illustrated in FIG. 14 and illustrating alternate water seals in dotted outline; and FIG. 16 is a detached view of an alternate configuration of a sealing element or an O-ring that allows the water to drain through the whirlpool jet proper.

DETAILED DESCRIPTION

Figure 1:
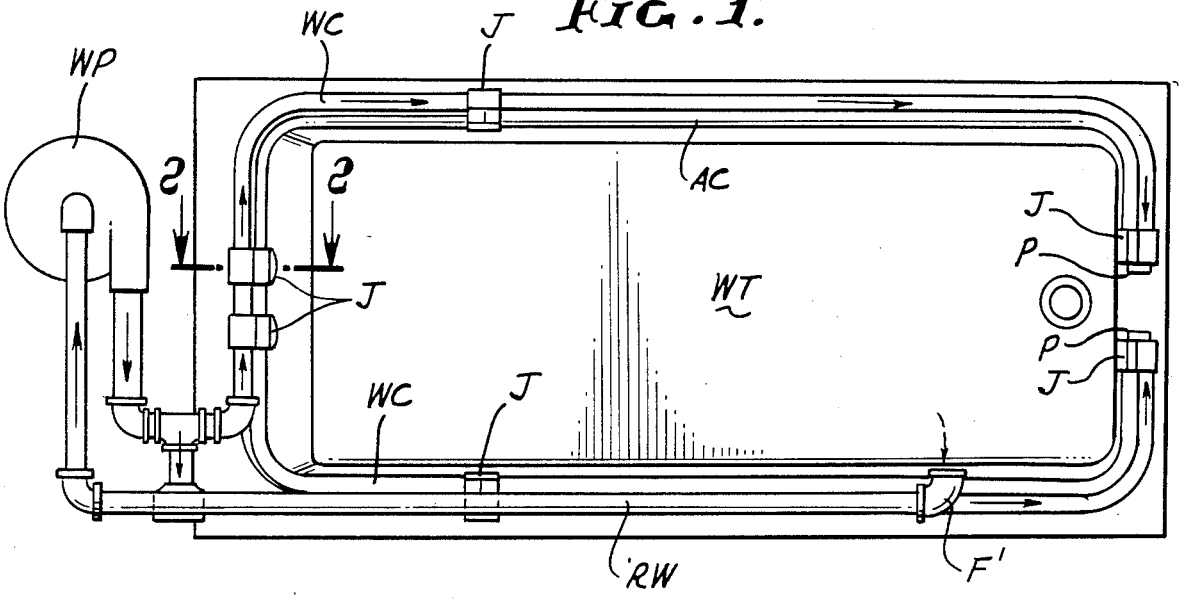
FIG. 1 is a bottom plan view of a whirlpool jet system installed on a bathtub and embodying the whirlpool jets of the present invention.

Now referring to the drawings, the present invention will be described in detail. Referring initially to the whirlpool jet system illustrated in FIG. 1, it should be noted that the system comprises a system for recirculating the water derived from a water vessel such as a bathtub WT to the whirlpool jet housings J by means of a water pump WP. The system illustrated in FIG. 1 is similar to the one disclosed in my U.S. Pat. No. 3,890,656 employing whirlpool jet housings J constructed and defined to permit water and air conduits to be slipped into apertures to couple the water and air to the whirlpool jet housings, from housing to housing. The water supply system is such that the whirlpool jet housings J are arranged in two parallel paths around the bathtub or water vessel WT, as illustrated in FIG. 1, so that the water that is derived from the water vessel WT is conveyed into the water pump WP by means of the water conduits WC and discharged from the water pump under pressure so as to be supplied to each of the whirlpool jet housings J. The air conduits AC for the whirlpool jet system derive the air from the ambient air which is drawn in as a result of the water under pressure being forced through the whirlpool jet housings J to cause the water and the air to mix and to be emitted into the bathtub or water vessel below the surface of the water. The water pump WP is conventionally driven by means of an electrical motor coupled thereto (not shown in the drawings). The water is recirculated to the water pump WP by a conduit RW communicating with the inside wall of the bathtub WT and arranged to be below the level of the water within the tub and to be conveyed to the water pump WP by means of the water return line RW. The water derived from the tub WT and delivered to the pump WP is discharged by the pump through its discharge outlet under pressure and is coupled by appropriate water conduits WC to each of the whirlpool jet housings J arranged in two parallel branches around the water tub WT. The arrangement of the water jet housings J, as illustrated in FIG. 1, is such that six whirlpool jet housings J are spaced around the bathtub WT. Two water jet housings J are arranged at the opposite ends of the tub WT, while a single whirlpool jet housing is arranged on opposite walls, as is clear from examining FIG. 1. The water from the tub WT is coupled to a water return outlet (not shown) that is normally arranged on the inside wall of the bathtub WT. The return water line RW is illustrated coupled between the return outlet by means of a ninety degree fitting F coupled to one end of the conduit RW with the opposite end thereof coupled to the water pump inlet and secured thereto in a conventional fashion. In this fashion the water that is pumped by the water pump WP is drawn from the tub WT and conveyed to the pump by the conduit RW. The water that is discharged from the pump WP is arranged to flow in two parallel paths around the tub WT to provide water under pressure for the six whirlpool jets J arranged around the tub. One path includes the two whirlpool jets J arranged at the left hand end of the bathtub WT, as illustrated in FIG. 1., along with one jet J on the top wall of the drawing and one at the top right hand side of the tub, all as illustrated in FIG. 1. The other parallel path includes a whirlpool jet J arranged on the bottom longitudinal side of the tub WT, as illustrated in FIG. 1, and the lower right hand whirlpool jet J. It will be recognized that the whirlpool jets J arranged at the right hand end of FIG. 1, as contrasted with the other four whirlpool jets J, do not have straight-through connections and for this purpose the jets J may all be constructed similarly, but the unused openings in the two right hand jets J can be provided with slip plugs P to prevent the water and air from passing all the way through the whirlpool jets J to provide the closed water and air paths.

The bathtub WT is also provided with an air control knob (not shown) of conventional construction which is accessible from the interior wall of the tub WT so that it may be manually controlled by the bather while in the tub. The air control knob is of conventional construction and is merely a screw-like arrangement for controlling the amount of ambient air that is drawn into the area by controlling the size of the opening at the air control knob. The air control knob is generally connected to the air conduits AC extending around the tub WT. One air conduit AC is coupled so as to run to each of the air apertures for the whirlpool jets J, as illustrated in FIG. 1. Accordingly, it should be evident that the amount of air that is discharged from the whirlpool jets J depends upon the setting of the air control knob so as to vary the volume of air that is drawn into the air conduits AC and thereby discharged into the tub WT.

Figure 2:
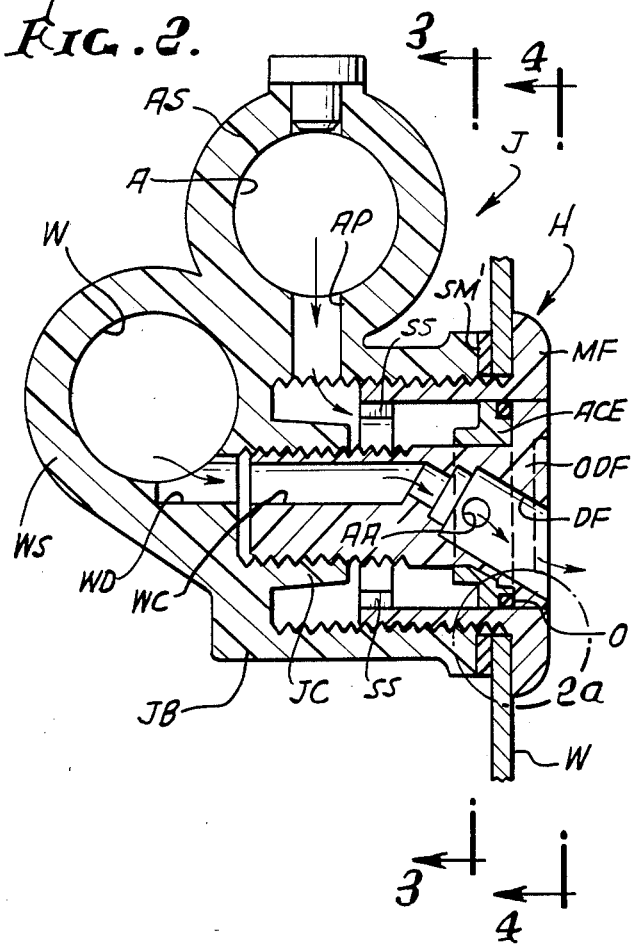
FIG. 2 is a sectional view taken along line 2—2 of FIG. 1 of the whirlpool jet housing embodying the present invention and illustrating the jet in a fully open position for conveying air and water therethrough.

Now referring to FIG. 2, the detailed construction of the improved whirlpool jet J of the present invention will be described. The whirlpool jet J illustrated in FIG. 2 comprises a water aperture W extending transversely to the housing JB along with an adjacent air aperture A also extending transversely to the jet body JB for the whirlpool jet J. The water aperture W and the air aperture A comprise parallel conduit stubs WS and AS, respectively, which allow slip fits to be made thereto by means of a corresponding plastic water conduit WC and a plastic air conduit AC and allow a straight-through connection by slip coupling water conduits WS and air conduits AS to both sides of the stubs WS and AS for the jet body JB for each jet J. The conduit stubs WS and AS are each molded integrally with the plastic jet body JB. The water entering from the conduits WC into the water aperture W is discharged into the interior of the jet body JB by means of a water discharge conduit WD arranged below the level of the water aperture W so as to allow the entire aperture W and the associated water conduit WC to drain into the interior of the jet body JB and from there into the water vessel WT, as will be described hereinafter. In this embodiment of the whirlpool jet the whirlpool jet body JB is defined with an inwardly extending coupling element JC that is illustrated in FIG. 2 as being internally threaded. The coupling element JC extends a preselected distance inwardly from the water discharge conduit WD, but is spaced inwardly from the right end of the jet body JB or from the discharge end. The air conveyed through aperture A is arranged in communication with a vertical air passage AP to permit the air to be drawn from the air conduits AC coupled to the apertures A downwardly into the passage AP in response to the water entering the body JB under pressure and entering at a relatively high speed to cause the air to be drawn into the housing by means of the venturi action, as is well known.

Figure 4:
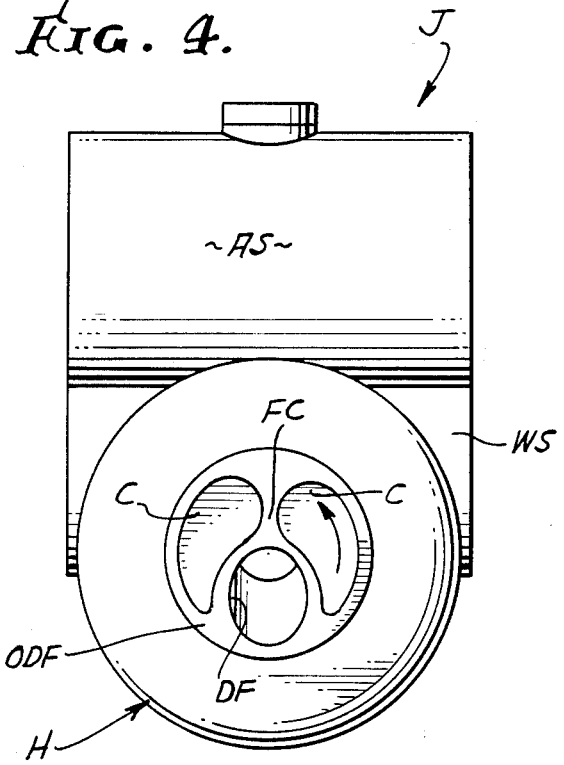
FIG. 4 is a front elevational view taken in the direction of line 4—4 of FIG. 2.
Figure 8:
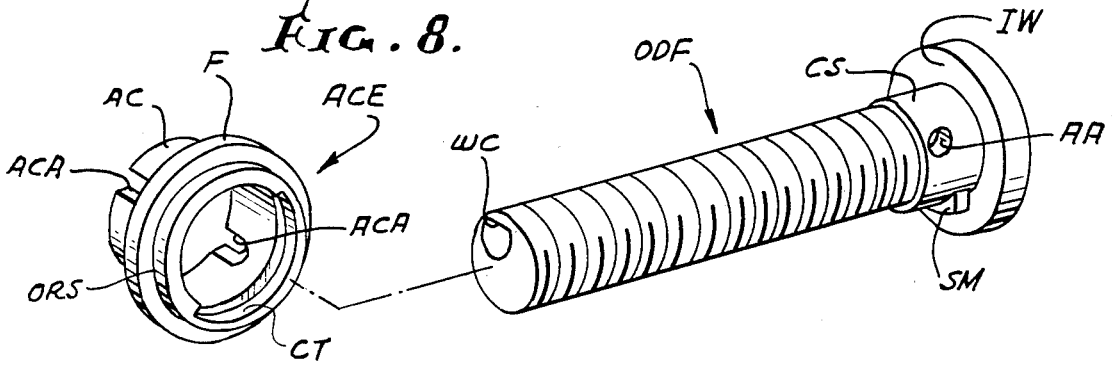
FIG. 8*s* is an exploded view of the whirlpool jet control means for shutting off the water and air to the whirlpool jet.

The whirlpool jet J includes as a single unitary element a combination orifice and directional flow identified as the element ODF. The combination orifice and directional flow ODF is an elongated element which has a longitudinally extending water conduit WC internally defined therein terminating in a directional flow DF. The water conduit WC is eccentrically spaced within the top half of the element ODF and communicates with the angularly defined directional flow DF, as illustrated in FIGS. 2 and 8. The directional flow DF accepts the water flowing in the conduit WC and is arranged to extend downwardly from the water conduit WC at a preselected angle to discharge the mixture of water and air therefrom. This arrangement of the directional flow DF provides positive directional flow of the water and/or the mixture of air and water discharged from the jet J. The left hand portion of the element ODF is externally threaded to be coupled to the coupling element JC of the jet body JB. In the arrangement illustrated in FIG. 2 the water conduit WC is arranged in alignment with the discharge conduit WD by being threaded thereto to permit the water conveyed to the jet J to be conveyed through the water conduit WC and then through the directional flow DF into the water vessel WT. The element ODF is adapted to be rotated relative to the jet body JB and the head H. The element ODF may be readily rotated within the jet J by the provision of a finger control FC constructed and defined on the front face of the element ODF as is best illustrated in FIG. 4. In examining FIG. 4 it will be noted that a pair of cavities C are defined on opposite sides of the finger control FC of a sufficient depth and width to accept a pair of fingers, such as the thumb and first finger of an individual, to permit the finger control FC to be grasped and thereby readily rotate the element ODF for purposes that will be made clear hereinafter.

The air that is admitted into the element ODF to be mixed with the water conveyed therethrough is admitted by means of a pair of air apertures AA defined to extend through the walls of the directional flow DF and are arranged at diametrically spaced locations (see FIG. 3) for admitting air therein. This means of mixing the water and air in the directional flow causes the water and air to bemixed immediately prior to being discharged from the directional flow DF, a feature unique to present day commercially available whirlpool jets. This advantageous arrangement prevents the loss of the action of the water, as occurs in prior art jets, and also does not compress the water. The air is drawn into the apertures AA as a result of the water under pressure rushing by the apertures in accordance with the well known venturi action.

The remaining element of the jet J is the head H. The head H is constructed and defined as a circular hollow element having a mounting flange MF defined on one end with a flat, inside surface to abut the inside wall W of the water vessel WT. In this particular construction the head H cooperates with the jet body JB which is arranged on the opposite side of the wall W from the head H for securing the jet J to the wall W. For this purpose the coupling between the head H and the body JD is provided by external threads for the head H that cooperate with the internal threads extending along the inside wall of the body JB, as is evident from FIG. 2. To prevent the leakage of the water along the interconnected threads of the body JB and the head H, a flat washer or similar sealing means SM is provided between the outer face of the wall W and the adjacent outer flat surface defined on the end of the body JB, as illustrated in FIG. 2. The head H in this instance is provided with a pair of arcuate segments SS that extend outwardly from the internal wall of the head H and are arranged intermediate the ends thereof. The segments SS each extend less than 180 degrees of the internal wall of the head H and each have their adjacent ends spaced apart a preselected distance, identified as the distance d in FIG. 3, to accept a coacting installation wrench for further securing the head H to the jet body JB and the jet J proper to the wall W in a watertight relationship, as will be discussed hereinafter.

Figure 2A:
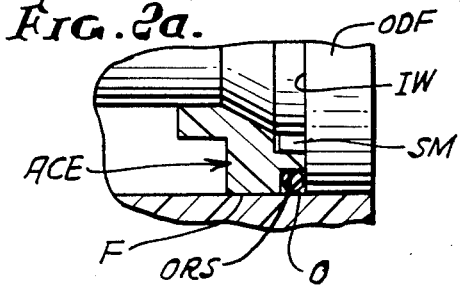
FIG. 2*a* is a partial enlarged view of the area 2*a* illustrated in FIG. 2.

As is evident from examining FIG. 2 and, in particular, the exploded view of FIG. 8, the combination orifice and directional flow element ODF may also be provided with an air control element ACE mounted adjacent the outer end of the element ODF on the opposite side of the finger control element FC or the wall IW. The element ODF is mounted on the unthreaded portion of the element ODF, designated as the control surface CS, through which the apertures AA extend. The air control element ACE is constructed and defined to be rotatable in response to the rotation of the element ODF to produce relative rotation between the control element ACE and the orifice and directional flow element ODF. For this purpose the air control element ACE is mounted with friction producing means illustrated in FIGS. 2 and 2*a* as a conventional O-Ring O. For coaction with the air control element ACE, the element ODF is provided with an arcuate stop member SM arranged on the surface CS between the apertures AA and below the apertures when the element ODF is operated to permit the water to fully flow therethrough and adjacent to and abutting the inside wall IW for the finger control FC. The detailed construction of the air control element ACE can be best appreciated by examining FIG. 8. The element ACE is an annular element to be slip fitted over the threaded end of the element ODF and to be rotatably fit to the control surface CS containing the apertures AA and the stop member SM. The air control element ACE is defined with an upstanding flange F intermediate its ends and an annular surface ORS extending outwardly from one side to abut the wall IW when mounted to the control surface CS and to secure the friction element O between the flange F and the surface IW. The inside wall of the annular surface ORS is provided with an arcuate control track CT to accept the stop member SM and allow the element ODF to be rotated relative to the air control element only to the arcuate extent of the control track CT; i.e., the stop member SM rotatably slides along the track CT from one end to the other end upon the rotation of the element ODF. The other end of the air control element ACE from the annular element ORS is another annular element AC extending outwardly from the flange F. The annular element AC is defined with a pair of diametrically spaced air conveying apertures ACA extending into the adjacent wall a preselected distance to coincide with the diameter of the air apertures AA defined on the control surface CS. When the air control element ACE is mounted on the control surface CS its length is defined to extend between the wall IW to approximately the first thread on the element ODF (when the threads terminate at the surfaces) so as to be rotatable on the surface CS. In this relationship the stop member SM is rotatably mounted in the control track CT. With the stop member adjacent one end of the control track CT, the apertures ACA for the element ACE are in radial alignment with the apertures AA for conveying air into the directional flow DF. Upon the production of relative rotation of approximately ninety degress between the elements ACE and ODF, the element ODF is rotated to place the apertures AA within the arcuate segments comprising the element AA to thereby block the communication between the air apertures AA and ACA, thereby shutting off the air from the directional flow DF. The relative rotation is produced between these two elements by the friction provided by the element O and the control track CT against the adjacent inner wall of the head H to prevent it from rotating with the element ODF. If the element ODF is rotated beyond the ninety degrees, the elements ACE and ODF rotate in unison since the stop member SM is in engagement with the opposite end of the track CT.

Figure 3:
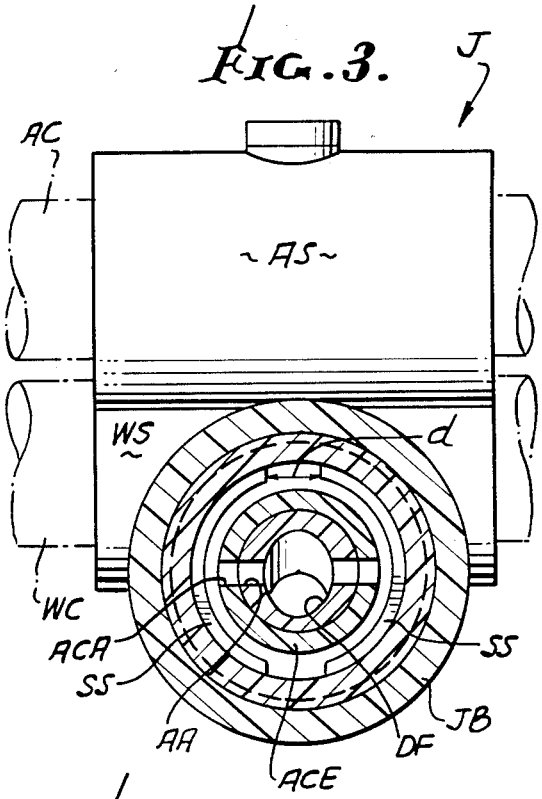
FIG. 3 is a sectional view taken along the line 3—3 of FIG. 2 with portions illustrated in elevation and the air and water conduits illustrated in dotted outline.

With the above structure in mind, the installation of the improved whirlpool jet J can now be appreciated. As indicated hereinabove, the jet body JB and the head H are placed on opposite sides of the wall W for the water vessel WT, the water vessel WT having been previously prepared with an aperture of the correct size to accept the outwardly protruding portion of the head H therein. Accordingly, the jet body JB is mounted with the sealing means SM against the outer face of the wall W and the head H extends into the jet body J with the inside surface of the flange for the head abutting in immedicate engagement with the inner wall W for the vessel WT. In this manner the head H may be coupled to the jet body JB by being threaded thereto to sandwich the sealing means against the wall W for installation of the jet body JB and the head H. The head H is tightened against the jet body JB to secure these two elements in place. It will be recognized that a final tightening of these parts may be accomplished by a suitable installation tool coacting with the segments SS defined on the internal wall of the head H and will be described hereinafter. After this is accomplished the unitary combination orifice and directional flow element ODF is coupled to the jet body coupling element JC which, in FIG. 2, is illustrated as a threaded relationship. The element ODF may be constructed of a standard length so that once it is threaded into the coupling element JC so that its inner end, or the end exposing the water conduit WC, is arranged in abutment with the interior wall of the element JC, the element ODF may extend a distance outwardly from the front face of the head H. In such a situation, then, the distance between the front face of the head H and the front face of the directional control FC is measured by means of a ruler or the like to determine the length of the element ODF that extends outwardly from the head H. Once this measurement is determined the element ODF can then be removed from the jet body JB. Accordingly, the inner end, or the left hand end, as illustrated in FIG. 8, of the element ODF may be cut off in accordance with the distance measured off from the front face of the head, as previously described. Once this is done, then the element ODF may then be, again, recoupled to the jet body JB by means of the element JB and should then be substantially flush with the front face of the head H, as illustrated in FIGS. 2 through 4.

When it is desired to have the full volume of both the air and the water discharged from the jet J, the finger control FC is rotated to a position wherein the directional control DF extends in a downwardly direction from the front face of the head H when the finger control FC is in a substantially vertical position in the manner illustrated in FIG. 4. With this arrangement, then, the air control element ACE will be positioned on the control surface CS so that the apertures ACA for the element ACE are in radial alignment with the apertures AA extending into the directional flow DF. Similarly, at this time, the combination orifice and directional flow element ODF will be positioned so that the longitudinal water conduit WC will be in axial alignment with the discharge conduit WD for the jet body JB. This, then, will allow full coupling of the water in the aperture W to flow through the conduit WD and into the water conduit WC to be conveyed to the directional flow DF and from there discharged into the water vessel WT. Prior to being discharged into the water vessel WT, the water in the directional flow DF draws in the air that is in the air aperture A by means of a venturi action and by means of the aperture AP and through the aligned apertures ACA and AA and is conveyed into the directional flow and is mixed with the water being conveyed therethrough. In this manner the mixture of water and air is discharged into water vessel WT.

Figure 6:
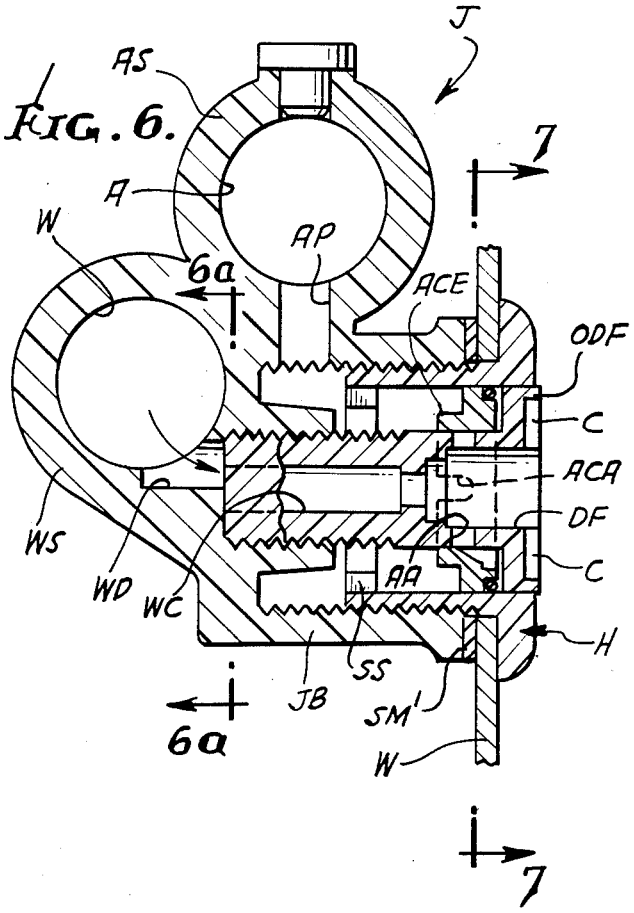
FIG. 6 is a sectional view taken along the line 6—6 of FIG. 5 with the air control means illustrated as having been rotated ninety degrees from the position illustrated in FIG. 2 to shut off the air supply.
Figure 7:
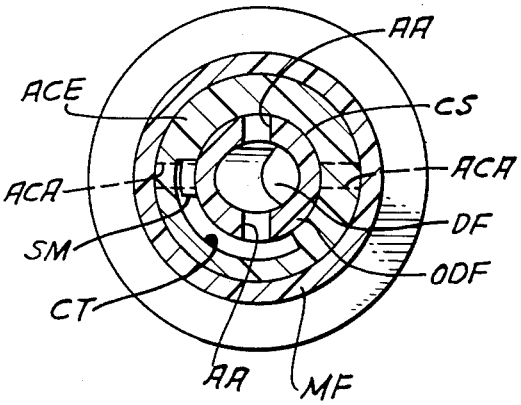
FIG. 7 is a sectional view taken along the line 7—7 of FIG. 6.
Figure 6A:
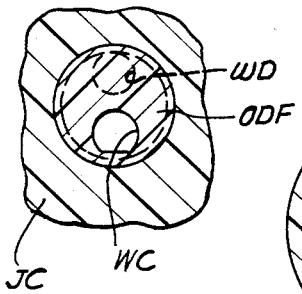
FIG. 6*a* is a partial sectional view taken along the line 6*a*—6*a* of FIG. 6 which illustrates the relative positions of the jet water conduit and the water conduit for the combination orifice and directional flow when the water is completely shut off.

If it is desired to shut off the air supply to the jet J, at the jet, this can be readily accomplished with the construction of the jet J by simply grasping the finger control FC on the front end of the element ODF, as particularly illustrated in FIG. 4, by grasping the element FC by the thumb and first finger at the point FC and rotating it approximately ninety degrees counterclockwise wherein the element ACE will be maintained in a stationary position while the element ODF will rotate through a ninety degree angle relative thereto. This results due to the friction provided by the O-ring O against the adjacent inner wall of the head H and the construction of the air control element ACE. During this interval the stop member SM defined on the control surface CS will rotate from one end of the control track CT to the other end and thereby cause the apertures AA for the element ODF to be rotated out of alignment with the apertures ACA on the air control element ACE. This amount of rotation, then, will completely shut off the air passages into the element ODF and, in particular, into the directional flow conduit DF. Under these conditions, then, only water is discharged from the jet J. In order to completely shut off both the air and the water at the jet J, or to control the volume of water that is discharged from the jet J, the finger control FC must be rotated further. It will be noted that, as a result of the threaded coupling of the element ODF with the coupling element JC, the inner end of the element ODF can assume various positions, depending on how far the inner end of the element ODF is spaced from the outlet of the water channel WD. When the two are in alignment and the adjacent wall of the element ODF abuts the inner wall of the coupling element JC it is merely necessary to rotate the element ODF to place the water conduit WC completely out of communication with the conduit WD to completely shut off the water. Even though this relationship is achieved, namely the nonalignment of the two water conduits WD and WC, if the element ODF is spaced from the inner wall of the coupling JC, water may still travel from the conduit WD and fill up the space between the elements so as to permit water to enter the conduit WC. Accordingly, this abutting relationship is necessary to fully shut off the water conduit WC. This nonalignment relationship is shown in detail in FIG. 6*a*. It will be appreciated from examining FIG. 6*a* that the rotation of the element ODF may place the water conduit WC in differing coupled relationships with the discharge conduit WD so as to vary the coupling between these two conduits and thereby vary the volume of water that is conveyed through the water conduit WC and discharged from the jet J. This water volume control is adjusted in accordance with the desires of the bather, as well as controlling the fully on and fully off positions of the water supply.

Figure 5:
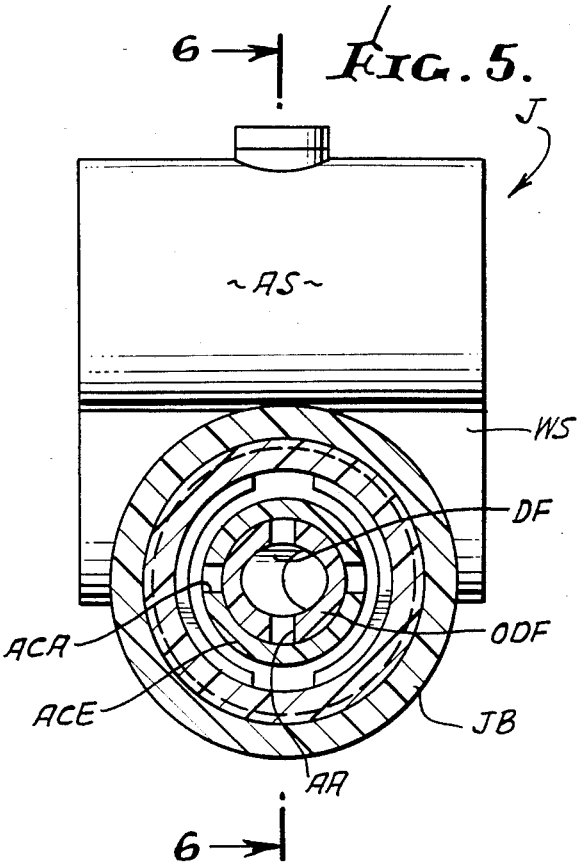
FIG. 5 is a front elevational view similar to FIG. 3 but illustrating the whirlpool jet in a closed position to prevent the conveyance of air therethrough.
Figure 9:
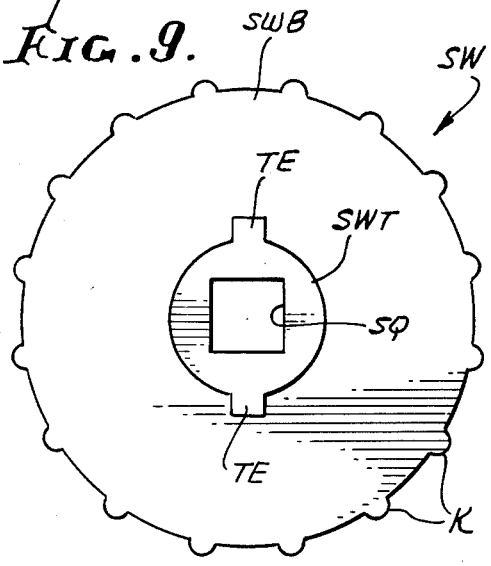
FIG. 9 is a front elevational view of the improved whirlpool jet installation tool, or spanner wrench.
Figure 10:
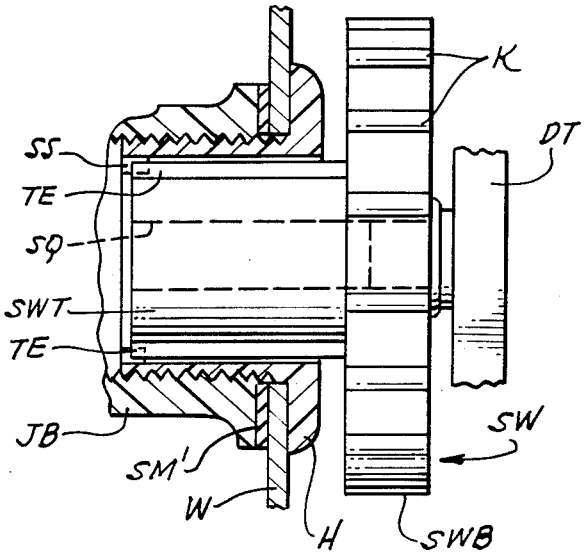
FIG. 10 is a partial illustration of the whirlpool jet housing and head illustrating the interrelationship of the installation tool of FIG. 9 mounted in the head portion of the whirlpool jet for tightly securing it to the wall of a water vessel.

Now referring to FIGS. 9 and 10, the improved jet installation wrench, or spanner wrench SW, will be described as it can be employed with the head H illustrated in FIGS. 2 and 10 for tightly securing the head H to the body JB on opposite sides of the wall W. The head H and the spanner wrench SW, illustrated in FIGS. 9 and 10, have been complementarily defined to produce the final tightening of the jet parts so as to eliminate the tightening holes that were required in my prior jets, such as that illustrated in my U.S. Pat. No. 3,946,449. The spanner wrench SW, in accordance with the present invention, is designed to provide extremely tight mounting of the head H and jet body JB to the wall of the water vessel WT, as in my prior patent. The spanner wrench illustrated in FIGS. 4 through 6 of my U.S. Pat. No. 3,946,449 is generally similar to the construction of the spanner wrench SW illustrated in FIGS. 9 and 10. To this end the spanner wrench SW comprises a plastic body member SWB, which is generally circular in construction. The outer periphery of the circular body member SWB is provided with knurling K to assist in the manual rotation of the installation tool SW, and is disclosed in my U.S. Pat. No. 3,946,449. The body member SWB is provided with a substantially centrally located, integral outwardly extending, cylindrical tightening member SWT. The cylindrical element SWT is provided with a pair of tightening elements TE that extend outwardly and longitudinally of the element TE and are diametrically spaced apart, as is evident from examining FIGS. 9 and 10. The elements TE are defined to be complementary to the space between the segments SS on the inside wall of the head H so as to be tightly interfitted within the spaces identified as "d" in FIG. 3 and the elements SS. In this fashion, then, when the wrench SW is inserted into the head, the elements TE will slide into engagement with the segments SS by filling up the spaces "d". The tool SW may then be manually rotated as far as possible in a tightening direction to tighten the jet parts JB and H to the wall W of the water vessel. To permit use of the wrench SW to further tighten the jet parts, the installation tool SW is defined with a square opening SQ which extends through the center of the body member SWB. This is provided (as in my previous spanner wrenches) to accept a driving tool DT, such as a ratchet wrench or speed wrench, that is inserted into the square opening SQ and through the center of the body member SWP, as illustrated in FIG. 10. This provides the added power which is required to make an extremely tight fit of the jet body parts to the wall W, as well as the sealing means SM. It will be recognized that once the elements of the jet J are tightly secured to the wall W the installation tool SW is removed from the head H and no unsightly tightening holes are visible from the front face of the head H. As indicated hereinabove, once this tightening operation of the jet elements JB and H is completed, the installation of the jet J can be completed by following the above described steps in coupling the element ODF to the element JB.

Figure 11:
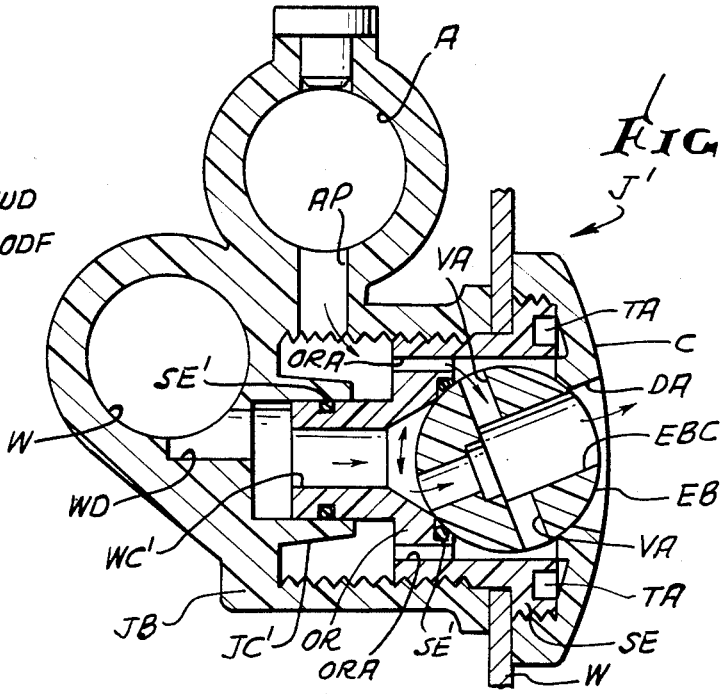
FIG. 11 is a cross sectional view of an alternative embodiment of the whirlpool jet for controlling the passage of water and air therethrough at the "eyeball" for the jet.

Now referring to FIG. 11, an alternate embodiment of the whirlpool jet will be described. The jet J' illustrated in FIG. 11 is generally of the same basic construction as the jet J described hereinabove, except that the directional flow control is by means of an "eyeball" identified as the element EB in FIG. 11. The "eyeball" arrangement of the jet J', however, is to control not only the direction of the flow of water and the air, but also to mix the air and the water in the eyeball EE immediately prior to discharging the mixture into the water vessel WT. The eyeball EB is rotatable within the jet proper so that the positioning of the elements EB controls the coupling of the water and the air, as in the previous embodiments. The jet J' includes a coupling element JC' that is basically the same as the element JC illustrated in FIG. 2, except that it is not internally threaded, but is defined to receive in a slip-fit relationship the orifice OR. The orifice OR is defined with a water conduit WC' for communicating with the water discharge conduit WD for the jet proper. The water conduit WC' is enlarged at one end to accept the element EB therein, as illustrated in FIG. 11. The orifice OR in this instance is constructed and defined to be secured to the jet body JB by being threaded thereto, and by the provision of the flanged end SE extends outside of the jet body to engage the inner wall W of the water vessel WT. For this purpose the orifice OR may be threaded to the inside wall of the jet body JB with the flanged portion SE engaging the inner surface of the wall W so that the orifice OR and the jet body JB are secured tightly to the opposite sides of the wall W. For this purpose a pair of tightening apertures TA may be provided on the portion SE for the orifice OR to accept a conventional spanner tightening wrench such as the one illustrated and described in my U.S. Pat. No. 3,946,449. To eliminate the tightening holes TA from view the jet J'.may be provided with a cover means C that is threadingly secured to the flanged element SE, as illustrated. The cover means C is provided with a central discharge aperture DA that allows access to the eyeball EB for positioning same and through which the water and air is discharged. The orifice OR mounts a sealing element SE adjacent the inner end thereof for providing sealing engagement between the coupling element JC' and the inner end of the orifice OR. The eyeball EB is mounted within the enlarged outer opening for the orifice OR so as to be rotatable therein. A further sealing element SE is mounted between the inside periphery of the eyeball EB and the discharge end of the orifice OR. The eyeball EB is provided with a water conduit EBC extending entirely throughout the length of the eyeball EB. For this purpose the conduit is defined in a stepped fashion, as illustrated in FIG. 11, with the enlarged bore functioning as the discharge end for the eyeball EB. In addition, the eyeball EB is provided with a pair of vertically extending air apertures VA communicating with the water aperture EBC through the eyeball to convey the air from the air passage AP through the orifice apertures ORA into the eyeball by means of the apertures VA. The apertures ORA extend longitudinally through the wall of the orifice OR and are diametrically spaced thereon. In this fashion, then, it will be noted that the air and water are mixed in the eyeball EB immediately prior to being discharged from the jet J'. The direction of discharge is not only controlled by the rotation of the eyeball EB, but the amount of coupling between the water and the air is also controlled as a result of the relative orientation of the orifice OR and the eyeball EB.

Now referring to FIG. 12, another alternate embodiment of the whirlpool jet J" will be described. The whirlpool jet J" is generally similar to the structure for the jet J illustrated in FIG. 2, except that the combination orifice and directional flow element ODF' is modified and is designed so as to solely control the flow of water from the water aperture W through the jet J". Accordingly, the air control element ACE illustrated in FIG. 2 is omitted from the structure of the element ODF' and the control surface CS is eliminated, as is evident from comparing FIGS. 2 and 12. Accordingly, the remaining structure for the jet J" is the same as described in conjunction with the embodiment of FIG. 2. It will be noted that the element ODF' is coupled to the coupling element JC by being threaded thereto, as was the element ODF of the FIG. 2 embodiment. The apertures AA, however, for admitting the air from the air aperture A through the conduit AP, are provided and are always in communication with the air aperture A, irrespective of the rotary position of the element ODF'. As will be noted, the water conduit WC is defined in the element ODF' in communication with the directional flow that is similarly constructed and identified as the element DF. Accordingly, the finger control afforded by the element ODF of the FIG. 2 embodiment can also be defined on the front face of the element ODF' and the water controlled continuously from a fully on to a fully off position, as described hereinabove in conjunction with the embodiment of FIG. 2.

Now referring to FIG. 13, yet another embodiment of the structure of the basic whirlpool jet J is illustrated and will be described. The modified whirlpool jet J''' is similar to the basic structure illustrated in FIG. 2 and, like the whirlpool jet J", is defined so as to control solely the flow of water through the jet J'''. The basic distinction between the embodiments of FIGS. 12 and 13 is the manner in which the combination orifice and directional control identified in FIG. 13 as the element ODF″ is coupled to the coupling element JC′ and secured to the head H′. The element ODF″ is not externally threaded, nor is the coupling JC′ internally threaded. The element JC′ is defined to slideably accept the left hand end of the alement ODF″ therein. A sealing means, such as the O-ring SM′, is defined adjacent the end of the element ODF″ to seal the water flow from the interior of the body JB. The air aperture is also modified for providing an elongated slot AA′ that admits the air from the air line AP into the directional flow DF. The outer end of the element ODF″ is provided with a head ODFH that is externally threaded so that the element ODF″ is coupled to the head H′ adjacent its forward end by being threaded thereto, as is evident from examining FIG. 13. The remaining portion of the jet J‴ then functions similarly to the embodiment of FIG. 12 by rotating the element ODF″ by means of the head ODFH. The amount of coupling between the water aperture WD and the water conduit WC for the element ODF″ is similarly controlled, including the control by the finger control defined on the front face of the element ODF″.

Now referring to FIG. 14, yet another embodiment of the jet J‴ will be described. The basic difference between the structure illustrated in FIG. 14 and that of FIG. 13 is that the directional control ODF‴ for the jet JF of FIG. 14 also includes the air control element ACE mounted thereon in accordance with the embodiment of FIG. 2. The element ODF‴ is slip-fit into the coupling element JC′ and has its outer end, or head ODFH, externally threaded to be secured to the head H′ in the same manner the two are coupled in the embodiment of FIG. 13. In this arrangement, then, both the air and the water may be controlled and the control function is identical to the arrangement illustrated and described for the embodiment of FIG. 2 for the jet J.

With regard to the directional control element ODF′ and the corresponding elements ODF″ and ODF‴ for the embodiments of FIGS. 13 and 14, it should be noted that the element can be considered a universal element and may be constructed in the fashion illustrated in FIG. 15. The element ODF″, then, is constructed similarly to the embodiment in FIGS. 13 and 14 and may have a standard length with the plurality of sealing elements, or O-rings SM, mounted at spaced apart locations along the elongated portion of the element ODF″. Again, as in the embodiment of FIG. 2, in installing the whirlpool jets J″ and J‴ and JF, the length of the combination orifice and discharge element ODF″ that extends from the front face of the head H′ can be measured to determine the amount of the stem of the element to be cut off. In this instance, a plurality of sealing elements may be provided for the element ODF″ and ODF‴ so that at least one sealing element will remain on the element ODF′ after it is cut to size, as illustrated.

It will be noted that in the embodiments of FIGS. 12 and 13, the sealing means between the wall W and the jets is omitted. This is merely for clarity purposes and any suitable sealing element may be provided at that point to conform to the embodiment of FIG. 2.

It will be noted that in the embodiments of FIGS. 12 and 13, for example, any water surrounding the combination orifice and directional flow could leak out through the space between the head and the combination orifice and directional flow or, in the case of FIG. 13, between the threads coupling the two. In the embodiments of FIGS. 2 and 14, the water will be retained due to the provision of the sealing element SM. To permit the water to be conveyed outside of the jet, the sealing means SM can be modified by substituting the sealing element SM″ illustrated in FIG. 16. The element SM″ is provided with a plurality of spaced apart friction surfaces FS sufficient to provide the relative rotation between the air control element ACE and the elements ODF for controlling the air and to provide a channel therebetween, such as the channel CH, to permit water to exit the jet.

In reviewing the structure for the whirlpool jet illustrated in FIG. 2 of my U.S. Pat. No. 3,890,656, it should be noted that these present day jets can be retro-fitted in accordance with the teachings of my present invention by substituting the combination orifice and directional flows ODF′ or ODF″ of FIGS. 12 and 13, respectively, for the directional flow illustrated in my aforementioned patent.

I claim:

1. A whirlpool jet housing comprising a body portion having a water inlet means including an aperture for conveying water into the body portion and an air inlet means including an aperture for conveying air into the body portion, a combination orifice and directional flow element of a unitary construction having an orifice at one end thereof arranged adjacent said water aperture to receive water directly therefrom and a directional flow at the opposite end thereof for discharge of water therefrom and with a longitudinally defined water conduit extending between the two ends, said water conduit having a preselected diameter at the orifice end and terminating at said directional flow end, the portion of the water conduit at the directional flow end having a water channel outlet that is angularly defined relative to the longitudinally defined water conduit and of a greater diameter than said preselected diameter for defining the directional flow and for inducing air into said angularly defined water channel by venturi action, said combination orifice and directional flow including aperture means for said angularly defined water conduit for conveying air therethrough by venturi action for mixture with the water in said conduit and to cause the mixed air and water to be discharged from the directional flow in a preselected direction, said air aperture means being in communication with said air inlet means, and a head adapted to be secured to the body portion so as to secure the whirlpool jet to a wall of a water vessel or the like through an aperture in the wall when the head and body are arranged on opposite sides of said wall without any additional securing devices, said head including an internally defined segment means for receiving and coacting with a complementary shaped wrench for tightly securing the body portion and head to said wall by means of an aperture through said wall.

2. A whirlpool jet housing comprising a body portion having a water inlet means including an aperture for conveying water into the body portion and an air inlet means including an aperture for conveying air into the body portion, a combination orifice and directional flow having an orifice at one end thereof arranged adjacent said water aperture to receive water therefrom and a directional flow at the opposite end thereof with a water conduit extending between the two ends, said combination orifice and directional flow including aperture means for conveying air therethrough for mixture with the water and to cause the mixed air and water to be discharged from the directional flow in a preselected direction, said combination orifice and directional flow is rotatable to place the orifice end of the water conduit in direct communication with said water inlet means and rotatable to a preselected position to place the orifice end of the water conduit out of communication with said water inlet means and thereby close off the water inlet means relative to said orifice, said combination orifice and directional flow including means rotatably mounted adjacent the directional flow whereby the aperture means for admitting air therein is positioned in response to the rotation of the combination orifice and directional flow to convey water therethrough and to permit the aperture means to draw air therein and to block off the aperture means in response to rotation of said orifice and directional flow to a position out of communication with said water inlet means, and a head adapted to be secured to the body portion so as to secure the whirlpool jet to a wall of a water vessel or the like through an aperture in the wall when the head and body are arranged on opposite sides of said wall without any additional securing devices, said head including an internally defined segment means for receiving and coacting with a complementary shaped wrench for tightly securing the body portion and head to said wall by means of an aperture through said wall.

3. A whirlpool jet housing comprising a body portion having water inlet means including an aperture for conveying water into the body portion and air inlet means including an aperture for conveying air into the body portion, control means rotatably coupled to said body portion, said control means including means for conveying water under pressure therethrough and for drawing air into the path of the water by venturi action to discharge a mixture of water and air from an end thereof, said control means being rotatable to a position coupling the water and air conveying apertures of said body to said control means for causing the water and air exiting said apertures to be conveyed through said water conveying means for said control means and being rotatable to another position to decouple the water and air apertures to substantially close off the flow of the mixture of water and air through said water conveying means.

4. A whirlpool jet housing comprising a body portion having water inlet means including an aperture for conveying water into the body portion and an air inlet means including an aperture for drawing air into the body portion, a combination orifice and directional flow having an orifice at one end thereof and a directional flow at the opposite end thereof with a water conduit extending between the two ends mounted within said body portion, said orifice and directional flow having a preselected diameter extending through the combination orifice and directional flow and a larger diameter than the preselected diameter at the directional flow end thereof for inducing air therein by venturi action, said combination orifice and directional flow including aperture means arranged at the directional flow for drawing air therein by venturi action for mixture with the water and to cause the mixed air and water to be discharged from the directional flow in a preselected direction, the aperture means being spaced downstream from said orifice and adjacent the discharge end of the directional flow, said water aperture and the orifice for the combination orifice and directional flow being eccentrically defined relative to one another for varying the water coupling between the aperture and the orifice from a fully coupled position when the orifice and water aperture are coaxial and a fully decoupled position when the orifice and water aperture are out of communication with one another upon the production of relative movement between the orifice and water aperture, said combination orifice and directional flow being rotatably mounted within said body portion with the orifice aligned opposite said water aperture when fully coupled to said water aperture for the body portion for receiving water directly from said water inlet means and rotatable relative to said body portion and said head for controlling the amount of coupling therebetween, and a head adapted to be coupled to the body portion for closing off the discharge end of the body portion and mounting said orifice and directional flow at said end while permitting rotational positioning of said orifice to vary the coupling between the orifice and conveying aperture for the body portion to permit the water conveyed through said combination orifice and directional flow to be continuously controlled between a fully coupled position to a fully decoupled position.

5. A whirlpool jet housing as defined in claim 4 wherein said water inlet means and air inlet means comprise side by side, mutually parallel, individual air and water conduits integrally molded with said body portion.

6. A whirlpool jet housing comprising a body having a water inlet means including an aperture for conveying water into the body portion and an air inlet means including an aperture for drawing air into the body portion, single control means coupled to said body portion adjacent said water aperture, said control means having a longitudinally defined water conveying channel of a preselected diameter terminating at one end of said control means and with the opposite end having a water channel outlet that is angularly defined relative to the longitudinally defined water channel for discharging water therefrom and of a greater diameter than said preselected diameter for inducing air into said angularly defined water channel by venturi action, said control means being coupled to said water aperture to receive and convey water through said water channel and including means for conveying air by venturi action into the control means to be mixed with the water in said channel of greater diameter to permit a mixture of air and water to be discharged from said water channel outlet, said air conveying means being in communication with said air inlet means and said aperture, and a head adapted to be coupled to the body portion for closing off the discharge end of the body portion and mounting the control means therein while permitting the position of the control means to be manually rotated relative to said body portion and said head.

7. A whirlpool jet housing comprising a body portion having a water inlet means including an aperture for conveying water into the body portion and an air inlet means including an aperture for drawing air into the body portion, control means coupled to said body portion adjacent said water aperture, said control means having a longitudinally defined water conveying channel of a preselected diameter terminating at one end in a water channel outlet that is angularly defined relative to the longitudinally defined water channel and of a greater diameter than said preselected diameter to function as a directional flow outlet, said control means being coupled to said water aperture to receive and convey water through said channel and including means for conveying air into the control means to be mixed with the water to permit a mixture of air and water to be discharged from said directional flow outlet, and a head adapted to be coupled to the body portion for closing off the discharge end of the body portion and mounting the control means therein while permitting the position of the control means to be manually rotated relative to the body portion and said head, said control means is rotatably coupled to said body portion for varying the coupling between the water and air aperture for said body portion to correspondingly vary the volume of water and air discharged from said directional flow outlet, said coupling being variable from a fully coupled position for admitting the maximum flow of air and water to a decoupled position for preventing the flow of water and air through said control means.

8. A whirlpool jet housing as defined in claim 6 wherein said control means is constructed and defined to cause the air and water to be mixed in said water channel outlet at a preselected point spaced from the discharge outlet of the directional flow for said control means.

9. A whirlpool jet housing as defined in claim 6 wherein water is conveyed into the body portion under pressure to cause air to be drawn into the control means at the air conveying means in accordance with venturi action.

10. A whirlpool jet comprising a venturi body portion having an aperture for conveying water into the body portion and an aperture for conveying air into the body portion, said body portion including side by side, mutually parallel individual water and air conduits integrally molded with said body portion, one of said conduits being constructed and defined relative to one of the water and air apertures to be in communication therewith with the other one of said conduits being constructed and defined relative to the remaining one of the water and air apertures to be in communication therewith, water and air conveying and discharging means coupled to said body portion with one end arranged adjacent said water aperture to directly receive water through said water aperture and having an internally defined, longitudinally extending water conveying channel of a preselected diameter to receive water conveyed through said water aperture and to discharge the water at the opposite end thereof, the portion of said water conveying channel adjacent the discharge end of the water conveying channel being defined with an angularly directed water discharge channel of a greater diameter than said preselected diameter of said channel for inducing air into said angularly defined water channel by venturi action, said water aperture and the water conveying channel being eccentrically defined relative to one another for varying the water coupling between the water aperture and the water conveying channel from a fully coupled position when the water conveying channel and water aperture are coaxial and a fully decoupled position when the water channel and water aperture are out of communication with one another upon the production of relative movement between the water channel and water aperture, said means including an air conveying aperture adjacent said opposite end to cause air to be drawn into the air conveying aperture and into said channel of greater diameter by venturi action and into the water in said water conveying channel to be mixed in said discharge channel prior to discharge from said means, said air conveying aperture being in communication with said air aperture, and a head adapted to be coupled to the body portion and coaxially mounting said water and air conveying and discharging means to permit the mixed water and air to be discharged therethrough while being secured to the adjacent end of the body portion.

11. A whirlpool jet housing as defined in claim 10 wherein said head comprises a flange constructed and defined at one end and a cylindrical portion extending outwardly therefrom for securement to said body portion in a telescoped relation therewith whereby the whirlpool jet may be secured to an apertured wall of a water vessel by means of the wall aperture when the head and body are arranged on opposite sides of the wall and are secured to one another through the wall aperture.

12. A whirlpool jet housing as defined in claim 11 wherein said head includes internally defined segments within said cylindrical portion and spaced a preselected distance inwardly of said flange for receiving and coacting with a complementary defined installation tool for tightly securing the body portion and head to the opposite sides of the wall mounting aperture.

13. A whirlpool jet as defined in claim 12 wherein said internally defined segments comprise a pair of arcuate segments extending inwardly from the interior wall of the cylindrical portion for said head and being spaced at diametrical points whereby a tool having longitudinally and outwardly extending protrusions defined at diametrically arranged points may be received within said cylindrical portion and extending therein with said outwardly extending protrusions being aligned within the diametrically arranged spaces between the arcuate segments to thereby hold the head to permit relative rotation between the head and body portion to tightly secure one to the other while sandwiching the wall of a water vessel therebetween.

14. A whirlpool jet housing comprising a body portion having an aperture for conveying water into the body portion and an aperture for conveying air into the body portion, said body portion including side by side, mutually parallel individual water and air conduits integrally molded with said body portion, one of said conduits being constructed and defined relative to one of the water and air apertures to be in communication therewith with the other one of said conduits being constructed and defined relative to the remaining one of the water and air apertures to be in communication therewith, control means coupled to said body portion with one end arranged adjacent said water aperture and having an internally defined, longitudinally extending water conveying channel to receive water conveyed through said water aperture and to discharge the water at the opposite end thereof, said water conveying channel being eccentrically defined relative to said water aperture for varying the water coupling between the aperture and the water conveying channel from a fully coupled position when the water conveying channel and the water aperture are coaxial and fully decoupled position when the water channel and water aperture are out of communication with one another upon the production of relative movement between the water conveying channel and the water aperture, said control means including an air conveying aperture adjacent said opposite end to cause the water in said water conveying channel to be mixed with air introduced through said air conveying aperture prior to discharge from the control means, and a head be coupled to the body portion and mounting said control means to permit the mixed water and air to be discharged therethrough while being secured to and closing off the body portion, said control means being rotatable relative to said body portion and said head to permit the coupling between the water aperture for said body portion and said water conveying channel to be continuously varied from a fully coupled position to cause the water to fully flow through said water channel and to a decoupled position to shut off the water from said water channel in response to the rotation thereof.

15. A whirlpool jet housing comprising a body portion having an aperture for conveying water into the body portion and an aperture for conveying air into the body portion, said body portion including side by side, mutually parallel individual water and air conduits integrally molded with said body portion, one of said conduits being constructed and defined relative to one of the water and air apertures to be in communication therewith with the other one of said conduits being constructed and defined relative to the remaining one of the water and air apertures to be in communication therewith, control means coupled to said body portion with one end arranged adjacent said water aperture and having an internally defined, longitudinally extending water conveying channel to receive water conveyed through said water aperture and to discharge the water at the opposite end thereof, said control means including an air conveying aperture adjacent said opposite end to cause the water in said water conveying channel to be mixed prior to discharge from the control means, a head adapted to be coupled to the body portion and mounting said control means to permit the mixed water and air to be discharged therethrough while closing off the body portion, said control means being rotatable relative to the body portion and said head to permit the coupling between the water aperture for said body portion and said water conveying channel to be continuously varied from a fully coupled position to cause the water to fully flow through said water channel and to a decoupled position to shut off the water from said water channel in response to the rotation thereof, and air control means mounted with said first mentioned control means adjacent said air conveying aperture to cause air to be conveyed into said water conveying channel when said channel is fully coupled to the water aperture and constructed and defined to permit relative rotation between said first mentioned control means and said air control means to cause said air conveying aperture for said first mentioned control means to be closed off in response to the rotation of said first mentioned control means.

16. A whirlpool jet housing as defined in claim 14 wherein said water conveying channel for said control means further includes a portion of the channel adjacent the discharge end thereof arranged at a preselected angle relative to the channel to direct the flow of the water and said air conveying aperture therefore being arranged to convey air into said portion of the channel to be mixed therein.

17. A whirlpool jet as defined in claim 14 wherein said water aperture for the body portion and the water conveying channel are arranged and defined to be fully coupled when said aperture and said channel are in longitudinal alignment and to be fully decoupled when said first mentioned control means is rotated to a position wherein said water aperture and said water conveying channel are completely out of longitudinal alignment to thereby prevent water from being conveyed through said water conveying channel.

18. A whirlpool jet as defined in claim 17 wherein said first mentioned control means is rotatable through approximately 180 degrees to assume said fully coupled and fully decoupled positions.

19. A whirlpool jet housing as defined in claim 14 wherein said head comprises a flange constructed and defined at one end and a cylindrical portion extending outwardly therefrom for securement to said body portion so as to secure the whirlpool jet to a wall of a water vessel or the like when the head and body portion are arranged on opposite sides of said wall and are secured to one another.

20. A whirlpool jet housing as defined in claim 19 wherein said head includes internally defined segments within said cylindrical portion for receiving and coacting with a complementary defined installation tool for tightly securing the body portion and head to the opposite sides of a mounting aperture provided on the wall.

21. A whirlpool jet as defined in claim 20 wherein said internally defined segments comprise a pair of arcuate segments extending inwardly from the interior wall of the cylindrical portion of said head and being spaced apart at diametrical points whereby a tool having longitudianlly and outwardly extending protrusions defined at diametrically arranged points may be received within said cylindrical portion and extending therein with said outwardly extending protrusions being aligned within the diametrically arranged spaces between the arcuate segments to thereby hold the head to permit relative rotation between the head and the body portion to tightly secure one to the other while sandwiching the wall of a water vessel therebetween.

22. A whirlpool jet housing comprising a body portion having a water inlet means including an aperture for conveying water into the body portion and an air inlet means including an aperture for conveying air into the body portion, a combination orifice and directional flow of a unitary construction having an orifice at one end thereof arranged adjacent to and in communication with said water aperture to receive water therefrom and a directional flow at the opposite end thereof for discharging water therefrom with a water conduit of a preselected diameter extending between the two ends, said combination orifice and directional flow including aperture means arranged at said directional flow for conveying air therethrough for mixture with the water in the combination orifice and directional flow, said aperture means being in communication with said air inlet means, the water conduit for the directional flow end of said combination orifice and directional flow being angularly defined in a preselected direction relative to said preselected diameter and of a greater diameter than said preselected diameter for the opposite end of said combination orifice and directional flow to cause air to be drawn into the aperture means by venturi action and the mixed air and water to be discharged from the directional flow end of said unitary orifice and directional flow, said water aperture and the orifice for the combination orifice and directional flow being eccentrically defined relative to one another for varying the water coupling between the aperture and the orifice from a fully coupled position when the orifice and water aperture are coaxial and fully decoupled position when the orifice and water aperture are out of communication with one another upon the production of relative movement between the orifice and water aperture, and a head adapted to be secured to the body portion so as to secure the whirlpool jet to a wall of a water vessel or the like through an aperture in the wall when the head and body are arranged on opposite sides of said wall without any additional securing devices, said head being substantially flush with said wall, said head rotatably mounting the combination orifice and directional flow to permit the latter element to be rotated relative to said body portion and said head.

23. A whirlpool jet housing comprising a body portion having a water inlet means including an aperture for conveying water into the body portion and an air inlet means including an aperture for conveying air into the body portion, a combination orifice and directional flow of a unitary construction having an orifice at one end thereof arranged adjacent to and in communication with said water aperture to receive water therefrom and a directional flow at the opposite end thereof for discharging water therefrom with a water conduit of a preselected diameter extending between the two ends, said combination orifice and directional flow including aperture means arranged at said directional flow for conveying air therethrough for mixture with the water in the combination orifice and directional flow, the water conduit for the directional flow end of the combination orifice and directional flow being angularly defined in a preselected direction relative to said preselected diameter and of a greater diameter than said preselected diameter for the opposite end of said combination orifice and directional flow to cause air to be drawn into the aperture means by venturi action and the mixed air and water to be discharged from the directional flow end at said angular relationship, and a head adapted to be secured to the body portion so as to secure the whirlpool jet to a wall of a water vessel or the like through an aperture in the wall when the head and body are arranged on opposite sides of said wall without any additional securing devices, said head rotatably mounting the combination orifice and directional flow to permit the latter element to be rotated relative to said body portion and said head, said combination orifice and directional flow being rotatable to place the orifice end of the water conduit in direct communication with said water inlet means and rotatable to a preselected position to place the orifice end of the water conduit out of communication with said water inlet means and thereby close off the water inlet means relative to said orifice, said combination orifice and directional flow including means rotatably mounted adjacent the directional flow whereby the aperture means for admitting air therein is positioned in response to the rotation of the combination orifice and directional flow to convey water therethrough and to permit the aperture means to draw air therein and to block off the aperture means in response to the rotation of said orifice and directional flow to a position out of communication with said water inlet means.

24. A whirlpool jet housing comprising a body portion having water inlet means including an aperture for conveying water into the body portion and an air inlet means including an aperture for drawing air into the body portion, a combination orifice and directional flow having an orifice at one end thereof and a directional flow at the opposite end thereof with a water conduit extending between the two ends mounted within said body portion, said orifice and directional flow having a preselected diameter at the directional flow end thereof for inducing air therein by venturi action, said combination orifice and directional flow including aperture means arranged adjacent the directional flow for drawing air therein by venturi action for mixture with the water and to cause the mixed air and water to be discharged from the directional flow in a preselected direction, the aperture means being spaced downstream from said orifice, said water aperture and the orifice for the combination orifice and directional flow being defined relative to one another for varying the water coupling between the aperture and the orifice from a fully coupled position when the orifice and water aperture are in communication and a fully decoupled position when the orifice and water aperture are substantially out of communication with one another upon the production of relative movement between the orifice and water aperture, said combination orifice and directional flow being rotatably mounted within said body portion with the orifice aligned to receive water from said water aperture when in communication with said water aperture for the body portion for receiving water directly from said water inlet means and rotatable relative to said body portion and said head for controlling the amount of coupling therebetween, and a head adapted to be coupled to the body portion for closing off the discharge end of the body portion and mounting said orifice and directional flow at said end while permitting rotational positioning of said orifice to vary the coupling between the orifice and conveying aperture for the body portion to permit the water conveyed through said combination orifice and directional flow to be continuously controlled between a substantially fully coupled position to a substantially fully decoupled position.

25. A whirlpool jet housing as defined in claim 24 wherein said water inlet means and air inlet means comprise mutually parallel, individual air and water conduits integrally molded with said body portion.

26. A whirlpool jet comprising a venturi body portion having an aperture for conveying water into the body portion and an aperture for conveying air into the body portion, said body portion including mutually parallel individual water and air conduits integrally molded with said body portion, one of said conduits being constructed and defined relative to one of the water and air apertures to be in communication therewith with the other one of said conduits being constructed and defined relative to the remaining one of the water and air apertures to be in communication therewith, water and air conveying and discharging means coupled to said body portion with one end arranged adjacent said water aperture to directly receive water through said water aperture and having an internally defined, longitudinally extending water conveying channel of a preselected diameter to receive water conveyed through said water aperture and to discharge the water at the opposite end thereof, a portion of said water conveying channel being defined for inducing air into said water channel by venturi action, said water aperture and the water conveying channel being defined relative to one another for varying the water coupling between the water aperture and the water conveying channel from a fully coupled position when the water conveying channel and water aperture are in communication and a fully decoupled position when the water channel and water aperture are out of communication with one another upon the production of relative movement between the water channel and water aperture, said water and air conveying and discharging means including an air conveying aperture to cause air to be drawn into the air conveying aperture by venturi action and into the water in said water conveying channel to be mixed prior to discharge from said means, said air conveying aperture being in communication with said air aperture, and a head adapted to be coupled to the body portion and coaxially mounting said water and air conveying and discharging means to permit the mixed water and air to be discharged therethrough while being secured to the adjacent end of the body portion.

27. A whirlpool jet housing comprising a body portion having an aperture for conveying water into the body portion and an aperture for conveying air into the body portion, said body portion including mutually parallel individual water and air conduits integrally molded with said body portion, one of said conduits being constructed and defined relative to one of the water and air apertures to be in communication therewith with the other one of said conduits being constructed and defined relative to the remaining one of the water and air apertures to be in communication therewith, control means coupled to said body portion with one end arranged adjacent said water aperture and having an internally defined, longitudinally extending water conveying channel to receive water conveyed through said water aperture and to discharge the water at the opposite end thereof, said water conveying channel being defined relative to said water aperture for varying the water coupling between the aperture and the water conveying channel from a substantially fully coupled position when the water conveying channel and the water aperture are in communication and substantially fully decoupled position when the water channel and water aperture are out of communication with one another upon the production of relative movement between the water conveying channel and the water aperture, said control means including an air conveying aperture to cause the water in said water conveying channel to be mixed with air introduced through said air conveying aperture prior to discharge from the control means, and a head adapted to be coupled to the body portion and mounting said control means to permit the mixed water and air to be discharged therethrough while being secured to and closing off the body portion, said control means being rotatable relative to said body portion and said head to permit the coupling between the water aperture for said body portion and said water conveying channel to be continuously varied from a fully coupled position to cause the water to fully flow through said water channel and to a decoupled position to substantially shut off the water from said water channel in response to the rotation thereof.

* * * * *

UNITED STATES PATENT AND TRADEMARK OFFICE

CERTIFICATE OF CORRECTION

PATENT NO. : 4,542,854

DATED : September 24, 1985

INVENTOR(S) : Cleo D. Mathis

It is certified that error appears in the above-identified patent and that said Letters Patent is hereby corrected as shown below:

On the cover sheet, Item [63] "Continuation of Ser. No. 315,491 October 27, 1983, abandoned." should read:

-- [63] Continuation of Ser. No. 315,491 Oct. 27, 1981, abandoned.--

Column 13, line 8, change "alement" to -- element --
Column 13, line 32, change "into" to -- onto --
Column 19, line 1, after "head" add -- adapted to --

Signed and Sealed this

*Twelfth* Day of *August 1986*

[SEAL]

*Attest:*

*Attesting Officer*

DONALD J. QUIGG

*Commissioner of Patents and Trademarks*